US007810323B2

(12) United States Patent
Iwamoto

(10) Patent No.: US 7,810,323 B2
(45) Date of Patent: Oct. 12, 2010

(54) LOAD CONTROL DEVICE FOR ENGINE OF WORK VEHICLE

(75) Inventor: Yuuichi Iwamoto, Komatsu (JP)

(73) Assignee: Komatsu Ltd., Tokyo (JP)

( * ) Notice: Subject to any disclaimer, the term of this patent is extended or adjusted under 35 U.S.C. 154(b) by 1032 days.

(21) Appl. No.: 10/578,315

(22) PCT Filed: Sep. 5, 2005

(86) PCT No.: PCT/JP2005/016237

§ 371 (c)(1),
(2), (4) Date: May 4, 2006

(87) PCT Pub. No.: WO2006/028042

PCT Pub. Date: Mar. 16, 2006

(65) Prior Publication Data

US 2009/0101101 A1 Apr. 23, 2009

(30) Foreign Application Priority Data

Sep. 6, 2004 (JP) ..... 2004-258476

(51) Int. Cl.
*F04B 49/00* (2006.01)
*F15B 11/00* (2006.01)

(52) U.S. Cl. ..... 60/431; 60/449; 60/486

(58) Field of Classification Search ..... 60/421, 60/422, 431, 452, 486, 449
See application file for complete search history.

(56) References Cited

U.S. PATENT DOCUMENTS 4,523,892 A * 6/1985 Mitchell et al. ..... 60/449
4,606,313 A * 8/1986 Izumi et al. ..... 60/434
4,663,936 A * 5/1987 Morgan ..... 60/422
4,773,369 A * 9/1988 Kobayashi et al. ..... 60/434
5,176,504 A * 1/1993 Moriya et al. ..... 60/428
5,673,557 A * 10/1997 Yoshida et al. ..... 60/421
5,967,756 A * 10/1999 Devier et al. ..... 417/18

(Continued)

FOREIGN PATENT DOCUMENTS

JP A-56-159580 12/1981

(Continued)

OTHER PUBLICATIONS

Refusing Reason Notice issued by the Japan Patent Office on Apr. 7, 2009 in the corresponding JP Patent Application No. 2004-258476 (and English Translation).

*Primary Examiner*—Thomas E Lazo
(74) *Attorney, Agent, or Firm*—Posz Law Group, PLC

(57) ABSTRACT

A device for use in a work vehicle such as a wheel loader, capable of reliably preventing engine stall due to rapid application of high hydraulic load, without causing problems such as deterioration in fuel efficiency or vehicle performance and waste of energy. When determining that an engine speed detected by the engine speed detecting sensor has been decreased to the threshold value or lower, the controller implements a control to reduce the absorption torque of the variable displacement hydraulic pump. The hydraulic load is thus shifted to a low hydraulic load line. The change of the hydraulic load from the high hydraulic load to the low hydraulic load gives a margin to the current torque of the engine with respect to the low hydraulic load. Consequently, the actual speed of the engine is increased to return onto the regulation line, exceeding the threshold value.

12 Claims, 9 Drawing Sheets

U.S. PATENT DOCUMENTS

| | | | | |
|---|---|---|---|---|
| 6,020,651 | A * | 2/2000 | Nakamura et al. | 290/40 R |
| 6,170,262 | B1 * | 1/2001 | Yoshimura et al. | 60/452 |
| 6,176,083 | B1 * | 1/2001 | Ikari | 60/422 |
| 6,405,844 | B1 * | 6/2002 | Takamatsu | 192/3.26 |

FOREIGN PATENT DOCUMENTS

| | | |
|---|---|---|
| JP | U-61-55183 | 4/1986 |
| JP | A-06-221301 | 8/1994 |

* cited by examiner

LOAD CONTROL DEVICE FOR ENGINE OF WORK VEHICLE

BACKGROUND

The present invention relates to a load control device for an engine of a work vehicle.

A wheel loader travels by an engine that drives drive wheels (traveling wheels) via a torque converter as a drive source. The engine also functions as a drive source for a steering mechanism and a work machine such as a loader. Specifically, a steering hydraulic pump is driven by the engine, and pressure oil discharged from the steering hydraulic pump is supplied to a steering hydraulic cylinder, whereby the steering mechanism is operated. Also, a loader hydraulic pump is driven by the engine and pressure oil discharged from the loader hydraulic pump is supplied to a loader hydraulic cylinder, whereby the loader is operated. The steering hydraulic pump and the loader hydraulic pump are provided with a fixed displacement hydraulic pump having a fixed displacement.

The traveling speed of the wheel loader varies according to a depressing amount of an accelerator pedal. This means that the engine speed is varied according to the depressing amount of the accelerator pedal, and the vehicle speed is varied according to the change in the engine speed. The target engine speed varies in a range from a low idling speed to a high idling speed.

The vehicle speed becomes zero by releasing the accelerator pedal to the non-depressed state, and the work is done in the halted state.

Thus, the wheel loader is operated more often with the target engine speed set to a low idling speed (idling mode) in comparison with other work vehicles such as a hydraulic excavator.

On the other hand, the engine has characteristics that the engine torque increases more slowly in response to a rapid increase of the hydraulic load when the engine speed is in a low speed range, or at a low idling speed than when in a high speed range, or at a high idling speed.

SUMMARY

An operator sometimes performs a work to raise a loaded loader (the boom and bucket) while turning the steering in the idling mode, and such a work involves rapid application of a high hydraulic load.

FIG. 3 shows a relationship between an engine speed N and an engine torque Te.

When the target engine speed is set to a low idling speed NL, the engine performs matching with a hydraulic load on a regulation line FL corresponding to the low idling speed NL. When the hydraulic load is low, the matching is established at the low-torque matching point V0 on the regulation line FL. If the operator rapidly operates the steering handle and the operating lever to carry out the above-described work to raise the loaded loader while turning the steering that involves rapid application of a high hydraulic load, the hydraulic load is rapidly increased and switched to the line indicated by Tp1. Consequently, the engine tries to raise the torque in order to match the same with this high hydraulic load Tp1 (the point V1 on the regulation line FL). However, as indicated by B, the increase of the engine torque cannot keep up with the rapid increase of the hydraulic load (time delay occurs), and the engine will stall.

In order to solve this problem, a possible measure is to set the low idling speed of the engine to a relatively high level to quicken the increase of toque during the idling of the engine, so that the engine torque can be increased as rapidly as the rapid increase of the high hydraulic load.

However, when the low idling speed of the engine is set to a relatively high level, a problem is induced that the fuel efficiency while idling is deteriorated. Additionally, when the low idling speed of the engine is set to a relatively high level, another problem is induced that stronger creep occurs in the torque converter.

In order to reduce the torque itself absorbed by the hydraulic pump, the displacement of the fixed displacement hydraulic pump may be set low. However, when the displacement of the fixed displacement hydraulic pump is set low, a problem is induced that the steering cannot be turned sufficiently during low idling. The steering of the wheel loader must be turned sufficiently even when the engine is idling (operating at a low idling speed). In order to supply a large amount of pressure oil to the steering hydraulic cylinder even at a low idling speed, a certain level of pump displacement must be ensured. If the pump displacement is small, a problem is induced that the maximum amount of flow that can be supplied to the hydraulic cylinder during low idling is decreased, and the speed of turning the steering is reduced. Additionally, if the displacement of the loader hydraulic pump is set small, the amount of flow is also decreased, the speed of raising or lowering the loader is reduced, and the working efficiency is impaired. Thus, the reduction of the displacement of the fixed displacement hydraulic pump will result in deterioration in the vehicle performance.

It will naturally be considered to increase the engine size to give the engine torque a sufficient margin in order to solve the problem. However, if the engine size is increased to avoid engine stall that rarely happens, it will induce increase of the cost and waste of energy.

The description above has been made in terms of the case in which high hydraulic load is applied during low idling. The risk of engine stall also exists when high hydraulic load is rapidly applied with the accelerator pedal being depressed. Therefore, the engine stall has to be prevented in such a case as well.

The present invention has been made in view of these circumstances. It is an object of the present invention to prevent engine stall in a rapid application of high hydraulic load in a work vehicle such as a wheel loader, without causing reduction of fuel efficiency, deterioration of vehicle performance, or waste of energy.

A first aspect of the present invention provides a load control device for an engine of a work vehicle, comprising: an engine (1) in which a target speed is set to a value in a range from a low idling speed to a high idling speed; a plurality of variable displacement hydraulic pumps (7, 8, 9) driven by the engine (1); a plurality of hydraulic actuators (13, 14, 15) to which pressure oil discharged from the plurality of variable displacement hydraulic pumps (7, 8, 9) is supplied; absorption torque changing means (19, 22, 23) for changing absorption torque for one or more of the variable displacement hydraulic pumps (7, 8, 9); engine speed detection means (1*a*) for detecting an engine speed; and control means (18) for reducing the absorption torque of the variable displacement hydraulic pump (7, 8, 9) when the detected engine speed decreased to a predetermined threshold value or lower.

A second aspect of the invention provides the load control device according to the first aspect of the invention, wherein the predetermined threshold value is an engine speed equal to or lower than the low idling speed.

A third aspect of the invention provides the load control device according to the first aspect of the invention, including: a hydraulic actuator (13) for activating a steering mechanism; and a hydraulic actuator (14) for activating a work machine.

A fourth aspect of the invention provides the load control device according to the first aspect of the invention, wherein the absorption torque changing means is means (19) for changing maximum absorption torque of the hydraulic pump.

A fifth aspect of the invention provides the load control device according to the first aspect of the invention, wherein the absorption torque changing means comprises: displacement control means (22) for controlling a displacement of the variable displacement hydraulic pump (8) such that a differential pressure between a discharge pressure of the variable displacement hydraulic pump (8) and a load pressure of the hydraulic actuator (14) becomes a set differential pressure; and means (23) for changing the set differential pressure.

A sixth aspect of the invention provides the load control device according to the first aspect of the invention, wherein the pressure oil is supplied from each of the plurality of variable displacement hydraulic pumps (7, 8, 9) to each of the plurality of hydraulic actuators (13, 14, 15) via each independent oil passage.

Operation and advantages of the first to sixth aspects of the present invention will be described with reference to the accompanying drawings.

When the operator rapidly operates the loader operating lever to the raising direction while operating the steering handle, the hydraulic load of the steering hydraulic pump 7 and the loader hydraulic pump 8 is rapidly increased.

As a result, as shown in FIG. 4A, the hydraulic load is shifted to a high hydraulic load line indicated by Tp1. The engine 1 tries to raise the torque so as to match the same with this high hydraulic load Tp1 (the point V1 on the regulation line FL). However, as indicated by C1, the increase of the engine torque cannot keep up with the rapid increase of the hydraulic load (time delay occurs), resulting in that the actual speed of the engine 1 becomes a threshold value Nr or lower.

When determining that the engine speed Nr detected by the engine speed detecting sensor 1*a* has been decreased to the threshold value Nc or lower, the controller 18 implements a control to decrease the absorption torque of the variable displacement hydraulic pumps 7, 8, and 9.

As a result, as shown in FIG. 4B, the hydraulic load is shifted to a low hydraulic load line indicated by Tp2. The change of the hydraulic load from the high hydraulic load Tp1 to the low hydraulic load Tp2 (the point V2 on the regulation line FL) allows the current torque of the engine 1 to be high enough with respect to the low hydraulic load Tp2. Accordingly, as indicated by C2, the actual speed Nr of the engine 1 is rapidly increased to return onto the regulation line FL, exceeding the threshold value Nc.

When determining that the detected engine speed Nr has exceeded the threshold value Nc, the controller 18 terminates the control to decrease the absorption torque of the variable displacement hydraulic pumps 7, 8, and 9. As shown in FIG. 4C, the hydraulic load thus returns to the high hydraulic load line Tp1 corresponding to the contents of the work currently done. Since the torque Te of the engine 1 has in the meantime been increased to some extent, it can be matched at the matching point V1 with the high hydraulic load Tp1.

As described above, the control to decrease the absorption torque of the variable displacement hydraulic pumps 7, 8, 9 may be terminated when the detected engine speed Nr becomes higher than the threshold value Nc. Alternatively, the control to decrease the absorption torque of the variable displacement hydraulic pumps 7, 8, 9 may be terminated upon elapse of a predetermined period of time after starting the control.

As described above, the absorption torque of the variable displacement hydraulic pumps 7, 8, 9 is decreased only for the minimum required period of time to prevent the engine stall, whereas the absorption torque remains at a normal level when there is no risk of engine stall. Further, the size of the engine needs not to be increased to give the engine torque a sufficient margin.

Accordingly, it is possible to reliably prevent the engine stall due to rapid application of high hydraulic load in a work vehicle such as a wheel loader, without causing problems such as deterioration in fuel efficiency or vehicle performance, and waste of energy.

Further, the existing PC control and mode selecting functions and devices provided in the wheel loader 100 as shown in FIG. 7 may be used to implement a PC control as indicated by the arrow D in FIG. 5, so that the maximum absorption torque by the hydraulic pumps 7, 8, 9 is decreased when the engine speed Nr becomes the threshold value Nc or lower (the fourth aspect of the invention). The use of the existing PC control and mode selecting functions and devices provided in the work vehicle makes it possible to further reduce the system cost required for realizing the engine stall prevention control.

Further, the existing LS control and differential pressure set value changing control functions and devices provided in the wheel loader 100 as shown in FIGS. 8A and 8B may be used to implement a differential pressure set value changing control as indicated by the arrow E in FIG. 6, so that the capacities of the hydraulic pumps 7, 8, 9 are decreased when the engine speed Nr becomes the threshold value Nc or lower (the fifth aspect of the invention). The use of the existing LS control and differential pressure set value changing control functions and devices provided in the work vehicle makes it possible to further reduce the system cost required for realizing the engine stall prevention control. According to the sixth aspect of the invention, as shown in FIG. 1, the above-described engine stall prevention control is performed on the assumption of a hydraulic circuit in which pressure oil is supplied from each of a plurality of variable displacement hydraulic pumps 7, 8, 9 to each of a plurality of hydraulic actuators 13, 14, 15 via each independent oil passage.

When employing a hydraulic circuit designed such that pressure oil is supplied from each of the plurality of variable displacement hydraulic pumps 7, 8, 9 to each of the plurality of hydraulic actuators 13, 14, 15 via each independent oil passage, the displacements of the hydraulic pumps 7, 8, 9 need to be determined respectively in accordance with the maximum loads of the hydraulic actuators 13, 14, 15. Therefore, the displacements of the variable displacement hydraulic pumps 7, 8, 9 tend to be larger. In contrast, when employing a hydraulic circuit designed such that flows of pressure oil discharged from the plurality of variable displacement hydraulic pumps are merged, and differential pressures between upstream and downstream of the control valves are adjusted by the pressure compensation valve before splitting and supplying the pressure oil to the plurality of hydraulic actuators, the amounts of flow can be allocated in accordance with the loads of the hydraulic actuators. Therefore, the displacements of the variable displacement hydraulic pumps can be made smaller.

Consequently, the hydraulic circuit according to the sixth aspect of the invention shown in FIG. 1 has a tendency that the hydraulic load becomes greater than a hydraulic circuit employing a pressure compensation valve, and hence more likely need to implement the engine stall prevention control.

A seventh aspect of the invention provides the load control device, wherein an operating element (17) is provided for setting a target engine speed according to an operating amount thereof; the predetermined threshold value is set according to the operating amount of the operating element (17); and the control means (18) reduces the absorption torque of the variable displacement hydraulic pump (7, 8, 9) when the detected engine speed decreases to the threshold value or lower.

Operation and advantages of the seventh aspect of the invention will be described with reference to the accompanying drawings.

When, for example, the operator rapidly operates the loader operating lever to the raising direction while operating the steering handle with the accelerator pedal being depressed, the hydraulic load in the steering hydraulic pump 7 and the loader hydraulic pump 8 is rapidly increased.

When the accelerator pedal 17 is depressed, a target engine speed NM is set corresponding to the depressing amount SM (see FIG. 10 and FIG. 9A). A threshold value Nc(SM) is determined according to the accelerator pedal depressing amount SM (see FIG. 10 and FIG. 9A).

As shown in FIG. 9A, the controller 18 determines whether or not the detected engine speed Nr has been decreased to the predetermined threshold value Nc(SM) or lower in the course when the accelerator pedal 17 is depressed to the operating amount SM and the matching point is shifted from the low speed and low hydraulic load matching point V0 (the point V0 on the regulation line FL) to the high speed and high hydraulic load matching point V2 (the point V2 on the regulation line FM). If the controller 18 determines that the detected engine speed Nr has been decreased to the predetermined threshold value Nc(SM) or lower, the controller 18 implements the control to reduce the absorption torque of the variable displacement hydraulic pumps 7, 8, and 9. The hydraulic load is thus shifted to the low hydraulic load line indicated by Tp2 as shown in FIG. 9A. As a result of the hydraulic load being changed from the high hydraulic load Tp1 to the low hydraulic load Tp2, the current torque of the engine 1 is allowed to have a margin with respect to the low hydraulic load Tp2, and the actual speed Nr of the engine 1 is increased rapidly.

If the controller 18 determines that the detected engine speed Nr is not equal to or lower than the predetermined threshold value Nc (S) in the course when the matching point is shifted from the low speed and low hydraulic load matching point V0 (the point V0 on the regulation line FL) to the high speed and high hydraulic load matching point V2 (the point V2 on the regulation line FM), the controller 18 terminates the control to reduce the absorption torque of the variable displacement hydraulic pumps 7, 8, and 9. Alternatively, the control may be terminated upon elapse of a predetermined period of time after starting the control to reduce the absorption torque of the variable displacement hydraulic pumps 7, 8, and 9.

As a result, the matching point is rapidly shifted to the matching point V2 on the regulation line FM.

As described above, the absorption torque of the variable displacement hydraulic pumps 7, 8, and 9 is reduced only for a minimum required period of time to prevent the engine stall or deterioration of the accelerating ability, whereas the absorption torque remains at a normal level when there is no risk of engine stall or deterioration of the accelerating ability. Further, the size of the engine needs not to be increased to give the engine torque a margin.

Consequently, the engine stall in a work vehicle such as a wheel loader can be prevented reliably even if a high hydraulic load is rapidly applied when the accelerator pedal is depressed, without inducing problems such as deterioration in fuel efficiency or vehicle performance, and waste of energy.

According to the present embodiment, the engine speed is rapidly increased to the target speed Nc (SM) when the accelerator pedal 17 is depressed, even under a high hydraulic load condition. Therefore, excellent accelerating ability can be obtained and the working efficiency can be improved remarkably.

DETAILED DESCRIPTION OF THE PREFERRED EMBODIMENTS

Embodiments of a load control device for an engine of a work vehicle according to the present invention will be described with reference to the accompanying drawings.

Figure 1:
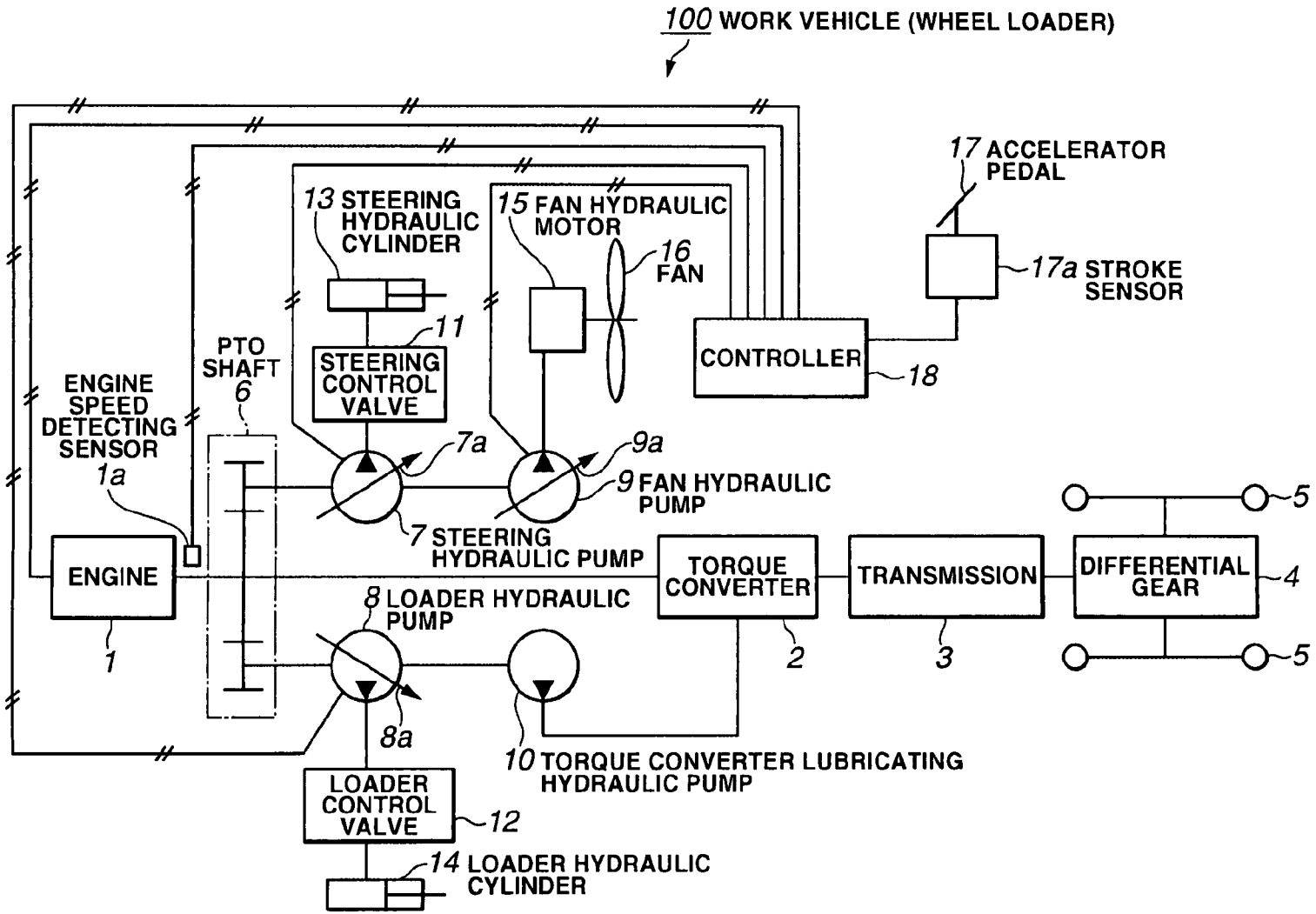
FIG. 1 is a diagram illustrating a configuration of a work vehicle according to an embodiment.

FIG. 1 illustrates a part of the configuration of a wheel loader relating to the embodiment of the present invention.

As shown in FIG. 1, the wheel loader 100 has an engine 1 in which the output shaft is coupled to a PTO shaft 6 coupled to a torque converter 2. The PTO shaft 6 is also coupled to a steering hydraulic pump 7, a loader hydraulic pump 8, a fan hydraulic pump 9, and a torque converter lubricating hydraulic pump 10.

The steering hydraulic pump 7, the loader hydraulic pump 8, and the fan hydraulic pump 9 are variable displacement hydraulic pumps, in which the pump displacement q (cc/rev) is changed by change of the tilt angles of the respective swash plates 7*a*, 8*a*, and 9*a*.

The output of the engine 1 is transmitted to drive wheels 5 via a torque converter 2, a transmission 3, and a differential gear 4.

The output of the engine 1 is also transmitted to the steering hydraulic pump 7, the loader hydraulic pump 8, the fan hydraulic pump 9, and the torque converter lubricating hydraulic pump 10.

As the steering hydraulic pump 7 is driven, discharged pressure oil is supplied to a steering hydraulic cylinder 13 via a steering control valve 11.

The steering hydraulic cylinder 13 is connected to a steering mechanism. As the steering hydraulic cylinder 13 is supplied with the pressure oil, the steering mechanism is activated and the vehicle body is turned. The spool of the steering control valve 11 is moved in response to operation of a steering handle (not shown). The opening area of the control valve 11 is changed according to the movement of the spool, whereby the amount of pressure oil supplied to the steering hydraulic cylinder 13 is changed.

When the loader hydraulic pump 8 is driven, discharged pressure oil is supplied to a loader hydraulic cylinder 14 via a loader control valve 12.

The loader hydraulic cylinder 14 is connected to a loader mounted in the front of the vehicle. The loader is activated when the loader hydraulic cylinder 14 is supplied with pressure oil. Specifically, the boom of the loader is raised or lowered and the bucket is tilted. The spool of the loader control valve 12 is moved in response to operation of a loader operating lever (not shown). The opening area of the control valve 12 is changed according to the movement of the spool, and thereby the amount of pressure oil supplied to the loader hydraulic cylinder 14 is changed.

When the fan hydraulic pump 9 is driven, discharged pressure oil is supplied to a fan hydraulic motor 1, whereby a cooling fan 16 is activated.

When the torque pump for torque converter lubrication 10 is driven, discharged pressure oil is supplied to the torque converter 2, whereby the torque converter 2 is lubricated.

An engine speed detecting sensor 1*a* is provided on the output shaft of the engine 1 for detecting an actual speed Nr of the engine 1. An engine speed Nr detected by the engine speed detecting sensor 1*a* is input to a controller 18.

The accelerator pedal 17 is operated by the operator. An operating amount (depressing amount) is detected by a stroke sensor 17*a* provided on the accelerator pedal 17 and a signal indicating the operating amount is input to the controller 18.

The controller 18 controls the engine 1 so as to achieve a target speed corresponding to the operating amount of the accelerator pedal 17. The engine 1 is a diesel engine, and the output control thereof is performed by adjusting the amount of fuel injected into the cylinder. This adjustment is performed by controlling a governor attached to a fuel injection pump of the engine 1. The governor typically used is an all speed control type governor, which adjusts the engine speed and the fuel injection amount according to the load so as to achieve a target speed corresponding to the depressing amount of the accelerator pedal. This means that the governor increases or reduces the fuel injection amount so as to nullify the difference between the target speed and the actual engine speed.

Figure 2:
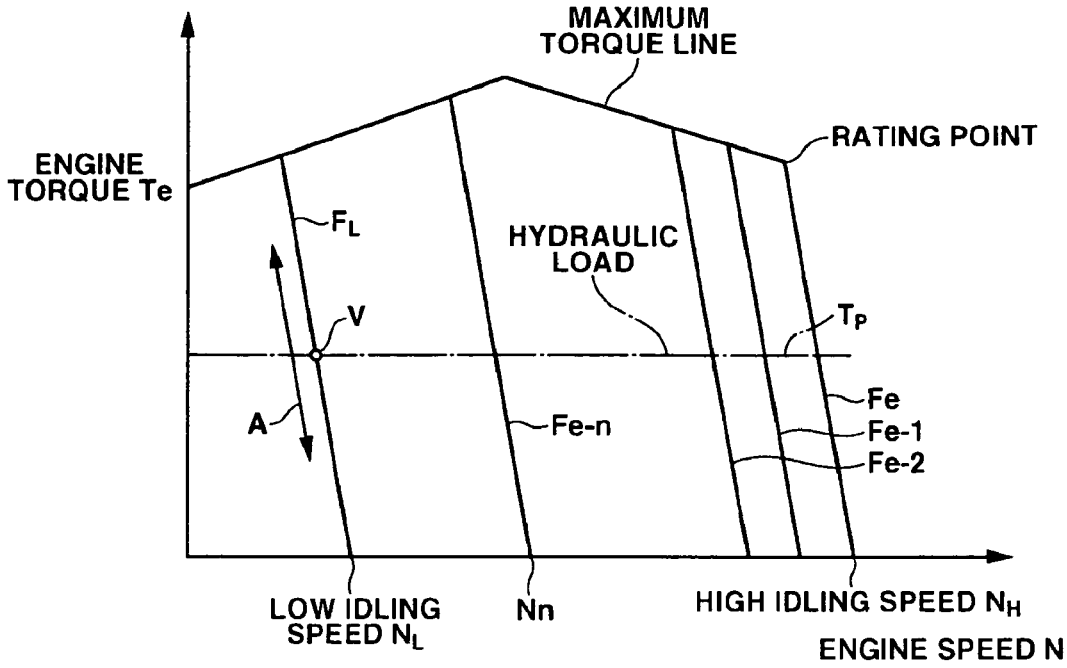
FIG. 2 is a diagram illustrating a relationship between engine speed and engine torque.

FIG. 2 shows a method of controlling the engine 1. In FIG. 2, the abscissa axis indicates an engine speed N, and the ordinate axis indicates an engine torque Te.

The region defined by the maximum torque line in FIG. 2 represents performance obtainable by the engine 1. The governor controls the engine 1 so that the torque will not exceed the maximum torque line to reach the exhaust smoke limit, and so that the engine speed N will not exceed the high idling speed NH to cause over speeding.

A maximum target speed is set when the accelerator pedal 17 is depressed to the maximum extent, and the governor controls the engine speed on a highest speed regulation line Fe connecting between a rating point and a high idle point NH.

As the depressing amount of the accelerator pedal 17 becomes smaller and the target speed is accordingly reduced, regulation lines Fe-1, Fe-2, . . . Fe-n, and FL are sequentially determined, and the speed adjustment is conducted on these regulation lines.

When the depressing amount of the accelerator pedal 17 is minimum, that is, when the accelerator pedal 17 is not depressed, a low idling speed NL is set as the target speed and the speed adjustment is conducted on the regulation line FL connecting the low idle point NL. When a hydraulic load Tp is varied as indicated by the arrow A, the matching point V at which the output of the engine 2 matches with the pump absorption horsepower is moved along the regulation line FL according to the variation of the hydraulic load Tp.

Figure 3:
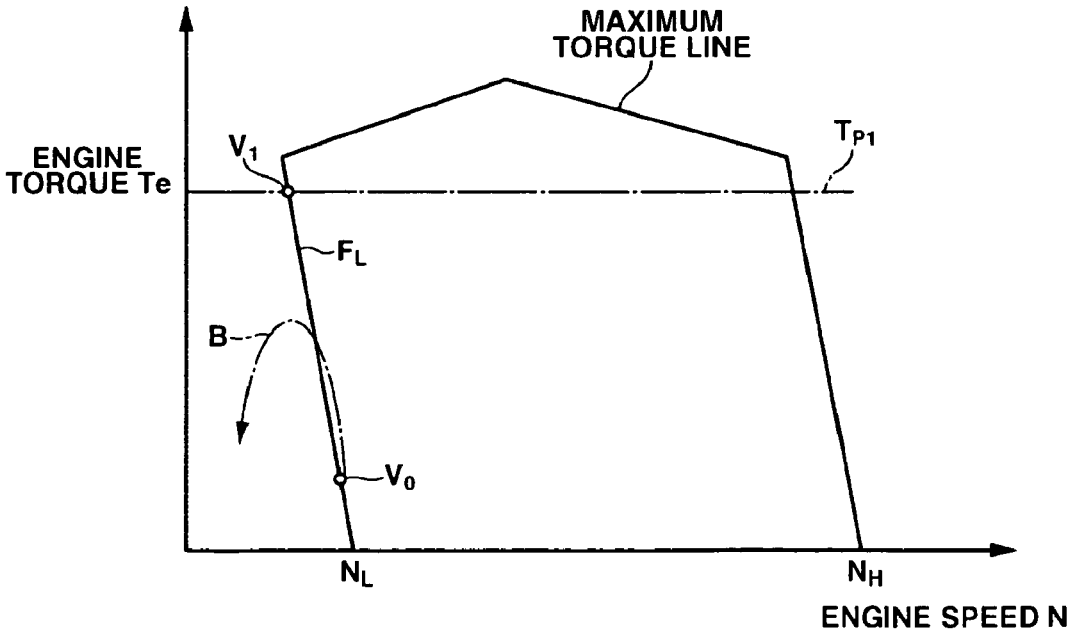
FIG. 3 illustrates how an engine stall occurs according to a prior art.

According to the characteristics of the engine 1, it takes more time for the matching point to move on the regulation line from the low load to the high load (the response of the engine 1 is slower) in the low-speed region (at the low idling speed NL) than in the high-speed region (at the high idling speed NH). Therefore, according to the conventional technique, as described above in relation to FIG. 3, the engine stall tends to occur when a high hydraulic load Tp1 is rapidly applied.

Figure 4A:
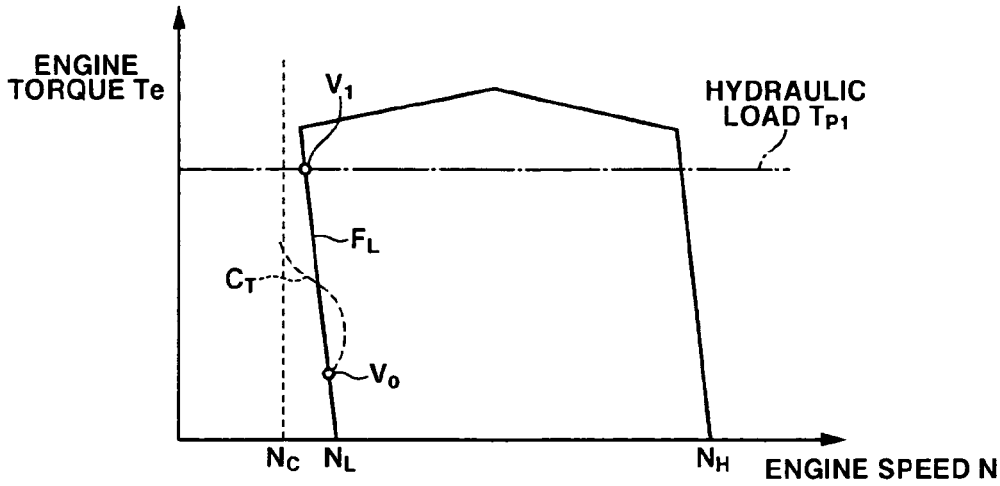
FIGS. 4A, 4B, and 4C are diagrams for explaining the particulars of an engine stall prevention control according to the embodiment.
Figure 4B:
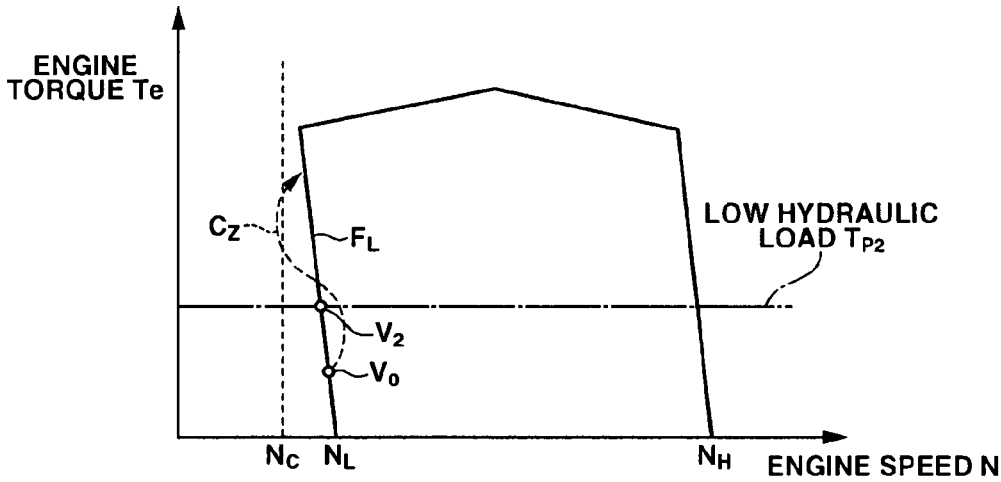
Figure 4C:
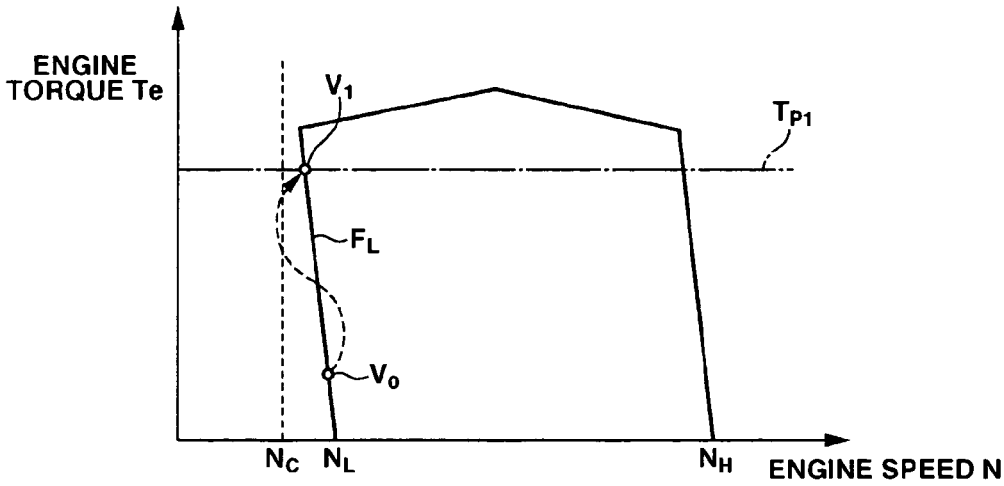

According to the present embodiment, therefore, the variable displacement hydraulic pumps 7, 8, 9 are provided with absorption torque changing means for changing the absorption torque, and the controller 18 is used to implement a control to reduce the absorption torque as shown in FIGS. 4A through 4C.

Figure 11A:
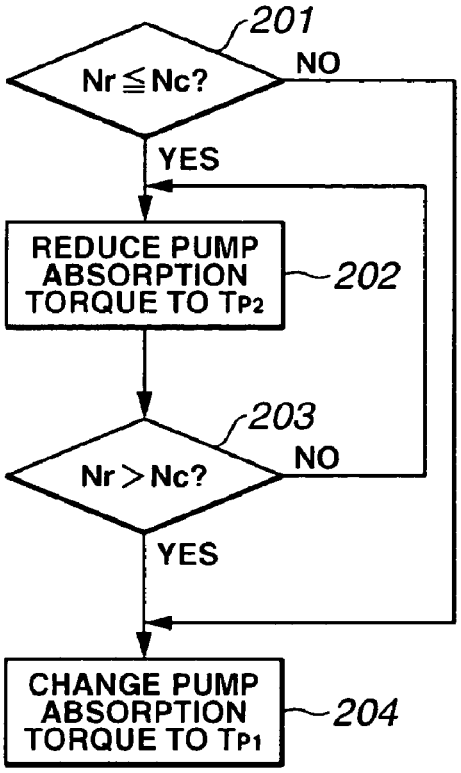
FIGS. 11A and 11B are flowcharts illustrating particulars of the control according to the embodiment.

A description will now be made with reference to the flowchart of FIG. 11A together with FIGS. 4A through 4C.

As shown in FIG. 4A, an engine speed Nc equal to or lower than the low idling speed NL is set as a threshold value. This threshold value Nc is set to an engine speed at which the engine 1 possibly stalls.

When the accelerator pedal 17 is not depressed and the hydraulic load is low, the matching is established at the low-torque matching point V0 on the regulation line FL.

If the operator rapidly operates the loader operating lever in the raising direction while operating the steering handle, the hydraulic load in the steering hydraulic pump 7, and the loader hydraulic pump 8 is raised rapidly.

As a result, the hydraulic load moves to the high hydraulic load line designated by Tp1 in FIG. 4A. The engine 1 thus tries to raise the torque so as to match the same with this high hydraulic load Tp1 (the point V1 on the regulation line FL). However, as indicated by C1, the increase of the engine torque cannot keep up with the rapid increase of the hydraulic load (time delay occurs), and the actual speed Nr of the engine 1 becomes equal to or lower than the threshold value Nc.

Determining that the engine speed Nr detected by the engine speed detecting sensor 1*a* has become the threshold value Nc or lower (determined YES in step 201), the controller 18 implements a control to reduce the absorption torque of the variable displacement hydraulic pumps 7, 8, and 9.

Consequently, the hydraulic load moves to the low hydraulic load line designated by Tp2 as shown in FIG. 4B. As a result of the hydraulic load being changed from the high hydraulic load Tp1 to the low hydraulic load Tp2 (the point V2 on the regulation line FL), the current torque of the engine 1 is made large enough to have a margin with respect to the low hydraulic load Tp2. Thus, the actual speed Nr of the engine 1 is increased as indicated by C2 to return onto the regulation line FL, exceeding the threshold value Nc (step 202).

Determining that the engine speed Nr detected by the engine speed detecting sensor 1*a* has exceeded the threshold value Nc (determined YES in step 203), the controller 18 terminates the control to reduce the absorption torque of the variable displacement hydraulic pumps 7, 8, and 9. Consequently, the hydraulic load returns to the high load line Tp1 according to the contents of the work currently performed as shown in FIG. 4C. However, the torque Te of the engine 1 has, in the meantime, been increased to some extent, and can be matched at the matching point V1 of the high hydraulic load Tp1 (step 204).

Figure 11B:
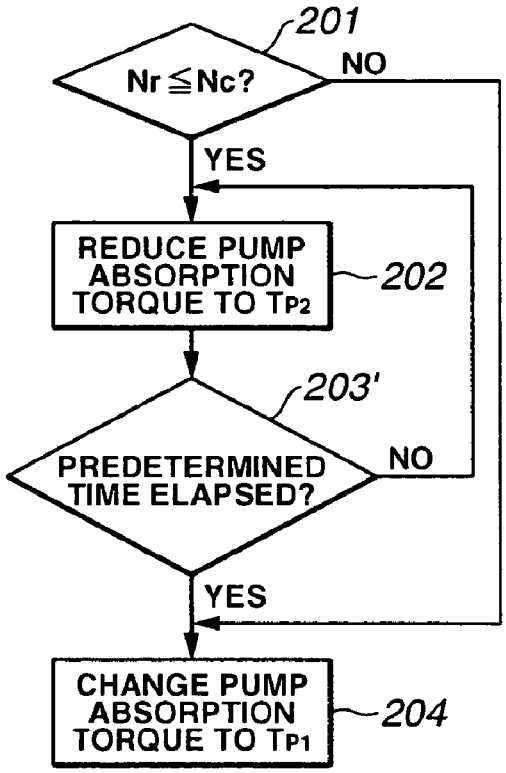

As described above, when the detected engine speed Nr becomes higher than the threshold value Nc (determined YES in step 203), the controller may terminate the control to reduce the absorption torque of the variable displacement hydraulic pumps 7, 8, and 9 (step 204). Alternatively, as shown in FIG. 11B, the controller may terminate the control upon elapse of a predetermined time after beginning the control to reduce the absorption torque of the variable displacement hydraulic pumps 7, 8, and 9 (determined YES in step 203) (step 204).

A description will now be made on a particular configuration example of the means for changing the absorption torque.

Figure 7:
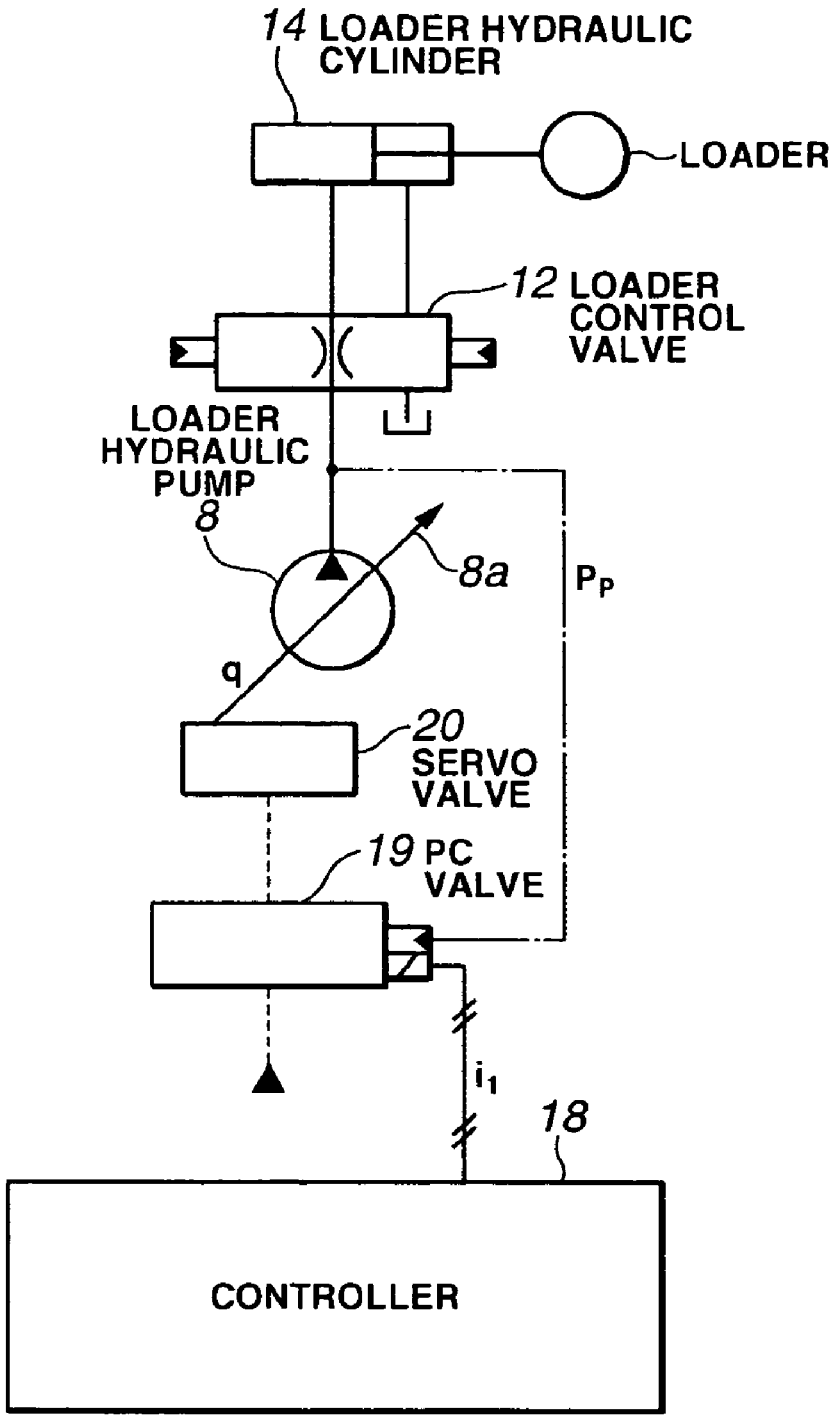
FIG. 7 is a diagram illustrating an example of a structure for performing a PC control.

FIG. 7 shows a configuration for controlling the loader hydraulic pump 8. Although the loader hydraulic pump 8 is representatively shown in FIG. 7, the same configuration can be employed for the PC control of the other variable displacement hydraulic pumps 7 and 9.

A PC valve 19 controls the tilt angle of a swash plate 7*a* of the hydraulic pump 8 such that a product of a discharge pressure Pp (kg/cm$^2$) of the hydraulic pump 8 and a displacement q (cc/rev) of the hydraulic pump 8 does not exceed a certain torque. If the engine speed of the engine 1 is fixed, the swash plate 8*a* of the hydraulic pump 8 is controlled so that a product of a discharge pressure Pp (kg/cm$^2$) of the hydraulic pump 8 and a flow rate Q (L/min) of the hydraulic pump 8 does not exceed a certain horsepower.

When the hydraulic pumps 7, 8, and 9 are to be PC controlled together, an average value of the discharge pressures of the pumps 7, 8, and 9 is input to the PC valve 19.

The PC valve 19 receives a discharge pressure Pp of the hydraulic pump 8 as a pilot pressure and provides drive pressure oil according to the discharge pressure Pp to a servo valve 20 to thereby control the displacement q of the hydraulic pump 8.

Particulars of the PC control will be described with reference to FIG. 5. The abscissa axis in FIG. 5 indicates a discharge pressure Pp (kg/cm$^2$) of the hydraulic pump 8, while the ordinate axis indicates a displacement q (cc/rev) of the hydraulic pump 8, or a tilt angle of the swash plate 8*a*.

Figure 5:
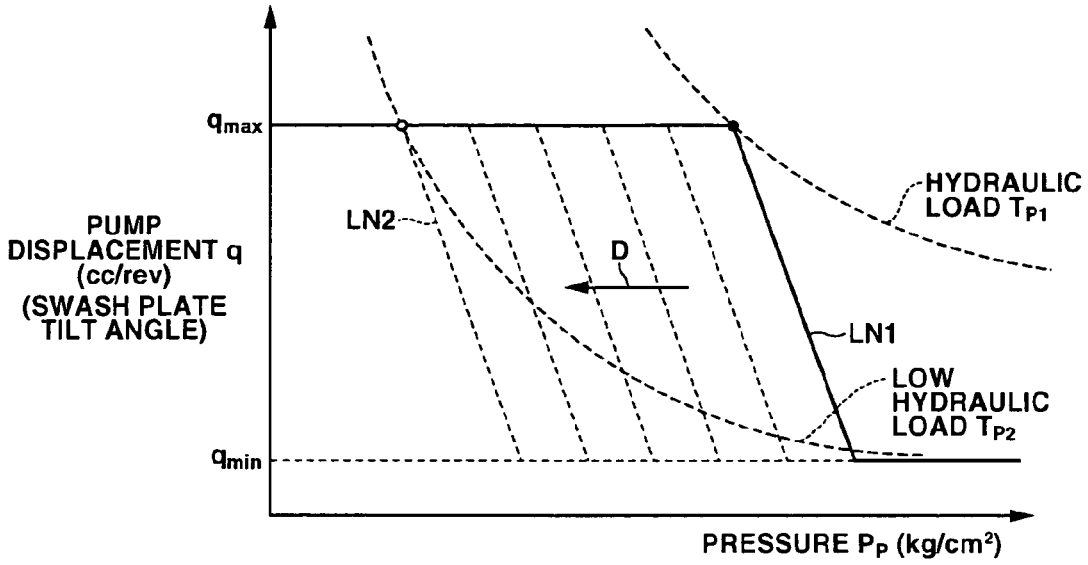
FIG. 5 is a diagram for explaining a control to change the maximum absorption torque of the hydraulic pump.

As shown in FIG. 5, when the discharge pressure Pp of the hydraulic pump 8 is a certain level or lower, the tilt angle of the swash plate 8*a* of the hydraulic pump 8 is set to its maximum and the displacement is a maximum displacement qmax. When the hydraulic load is increased and the pump discharge pressure Pp exceeds the certain level, the pump displacement q is decreased according to the characteristic LN1, whereby the swash plate tilt angle is minimized and the displacement becomes a minimum displacement qmin.

In a manner as described above, the pump displacement q of the hydraulic pump 8 is controlled according to the pump discharge pressure Pp in a range where the hydraulic load, or the absorption torque does not exceed the maximum absorption torque Tp1.

The PC valve 19 is provided with a control signal i1 from the controller 18, and the maximum absorption torque is changed according to this control signal i1. An operation panel (not shown) is provided with a "mode switch" so that the maximum absorption torque value varies according to the mode selected with the mode switch.

When a certain mode is selected, the maximum absorption torque by the hydraulic pump 8 is set to a large value Tp1, and the hydraulic pump 8 is controlled according to the characteristic LN1. When another mode is selected, the characteristic LN1 is changed to the characteristic LN2 as indicated by the arrow D, whereby the pump discharge pressure value at which the reduction of the pump displacement is started is decreased, and the maximum absorption torque value is set to a smaller value Tp2.

According to the present embodiment, as described above, the control to prevent the engine stall is performed by utilizing the existing PC control and mode setting functions and devices provided in the wheel loader 100.

Specifically, the controller 18 outputs a control signal i1 to the PC valve 19 to set the maximum absorption torque by the hydraulic pump 8 to the large value Tp1 when the engine speed Nr detected by the engine speed detecting sensor 1*a* is higher than the threshold value Nc. When the engine speed Nr detected by the engine speed detecting sensor 1*a* becomes equal to or less than the threshold value Nc, the controller 18 outputs a control signal i1 to the PC valve 19 to set the maximum absorption torque by the hydraulic pump 8 to the small value Tp2. When the engine speed Nr detected by the engine speed detecting sensor 1*a* again becomes higher than the threshold value Nc, the controller 18 outputs a control signal i1 to the PC valve 19 to set the maximum absorption torque by the hydraulic pump 8 to the large value Tp1. These procedures realize the control as shown in FIGS. 4A, 4B, and 4C, whereby the torque of the engine 1 can be increased in accordance with the hydraulic load of the engine 1 to establish matching at the matching point V1 of the high hydraulic load Tp1 without causing the engine to stall.

The set value of the maximum absorption torque by the hydraulic pump 8 may be returned to the large value Tp1 upon elapse of a predetermined period of time after the maximum absorption torque by the hydraulic pump 8 is set to the small value Tp2.

According to the present embodiment as described above, the engine stall due to rapid application of a high hydraulic load to the engine 1 can be prevented by utilizing the existing PC control and mode selecting functions and devices provided in the wheel loader 100.

Figure 8A:
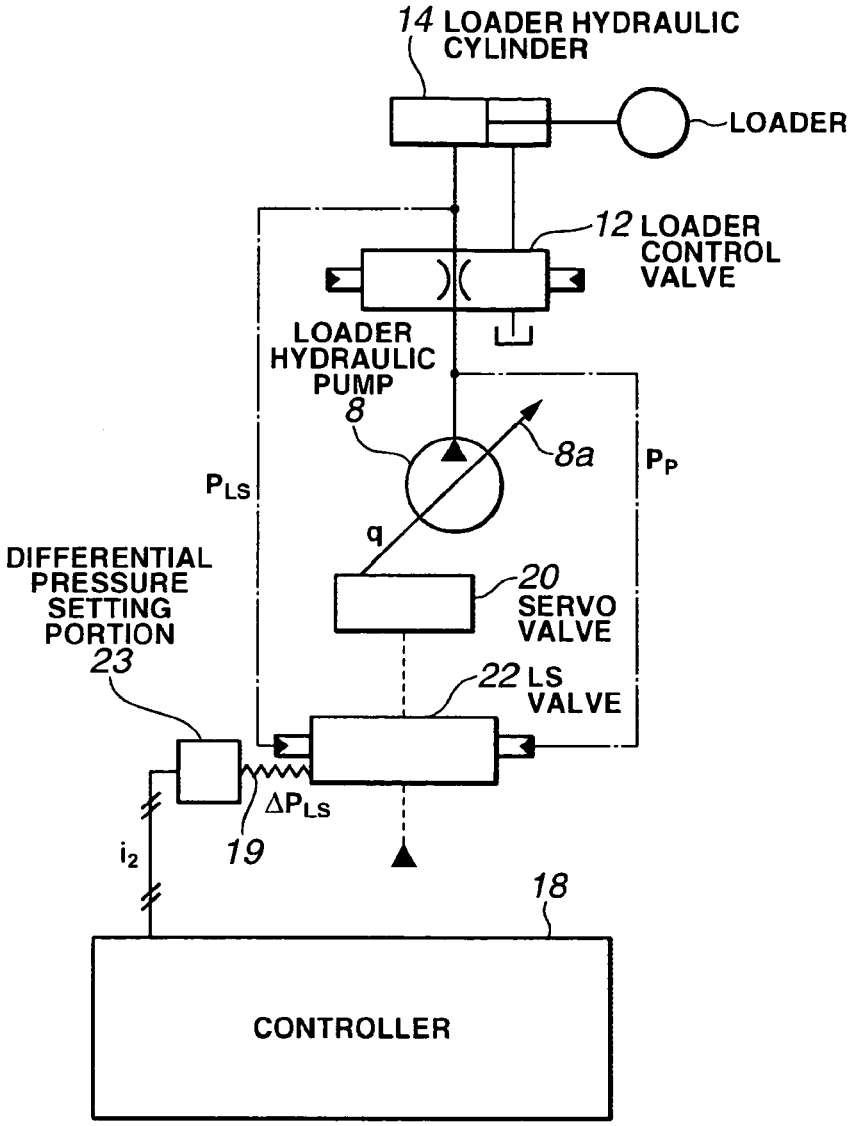
FIGS. 8A and 8B are diagrams illustrating an example of a structure for performing an LS control.

FIG. 8A illustrates a configuration for LS controlling the loader hydraulic pump 8. Although the loader hydraulic pump 8 is representatively shown in FIG. 8A, the same configuration can be employed for the LS control of the other variable displacement hydraulic pumps 7 and 9.

LS valve 22 controls the tilt angle of the swash plate 8*a* of the hydraulic pump 8 such that a differential pressure ΔP between a discharge pressure Pp of the hydraulic pump 8 and a load pressure PLS of the loader hydraulic cylinder 14 becomes a fixed differential pressure ΔPLS.

The LS valve 22 is provided with a spring for setting the fixed differential pressure ΔPLS. The discharge pressure Pp of the hydraulic pump 8 is applied as a pilot pressure to the pilot port of the LS valve 22 that is located on the opposite side from the spring, while the load pressure PLS of the loader hydraulic cylinder 14 is applied as a pilot pressure to the pilot port on the spring side. The drive pressure oil is supplied from the LS valve 22 to the servo valve 20, whereby the displacement q of the hydraulic pump 8 is controlled.

When the opening area of the loader control valve 12 is denoted by A and the resistance coefficient is denoted by c, the discharge flow rate Q of the hydraulic pump 8 is represented by the equation, $Q=c\cdot A\cdot\sqrt{(\Delta P)}$. The differential pressure ΔP is made fixed by the LS valve 22. Therefore, the pump flow rate Q is varied only by the opening area A of the spool of the control valve 12.

As the loader operating lever is operated, the opening area A of the loader control valve 12 is increased according to the operating amount, and the pump flow rate Q is increased according to the increase of the opening area A. The pump flow rate Q is not affected by the hydraulic load, but is determined only depending on the operating amount of the loader operating lever. Thus, the provision of the LS valve 22 enables the pump flow rate Q to be varied precisely according to the operator's intension (according to the operated position of the loader operating lever) without being increased or decreased by the hydraulic load. Accordingly, the fine controllability, or the operability in the intermediate operation region is improved.

However, the discharge flow rate when the engine 1 is in the low speed range becomes the same as when in the high speed range since a flow rate to meet a request from the loader hydraulic cylinder 14 is always supplied even when the maximum flow rate of the hydraulic pump 8 is not exceeded, for example during fine control.

Therefore, the controller 18 implements a control to reduce the differential pressure set value ΔPLS to decrease the discharge flow rate when the engine speed of the engine 1 is low. The LS valve 22 is provided with a differential pressure setting portion 23 for changing the set spring force of the spring. When the controller 18 outputs a control signal i2 to the differential pressure setting portion 23, the differential pressure setting portion 23 varies the set spring force of the spring of the LS valve 22 to change the differential pressure set value ΔPLS.

Figure 8B:
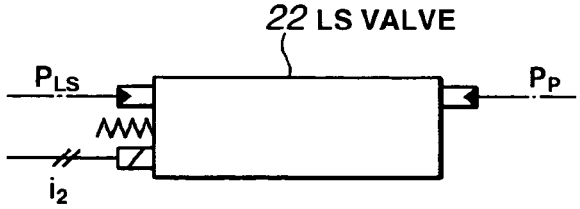

As shown in FIG. 8B, the control signal i2 may be applied to an electromagnetic solenoid of the LS valve 22 to change the set spring force of the spring of the LS valve 22 so as to change the differential pressure set value ΔPLS.

Particulars of such differential pressure set value changing control will be described with reference to FIG. 6. The abscissa axis in FIG. 6 indicates a discharge pressure Pp ($kg/cm^2$) of the hydraulic pump 8, while the ordinate axis indicates a displacement q (cc/rev) of the hydraulic pump 8, or a tilt angle of the swash plate 8*a*.

Figure 6:
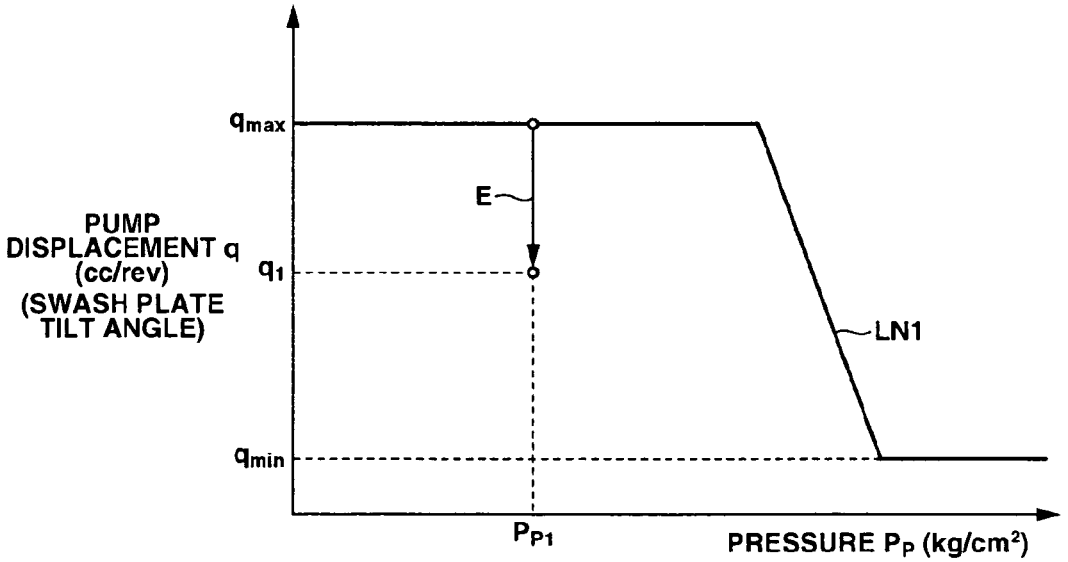
FIG. 6 is a diagram for explaining a control to change the displacement of the hydraulic pump.

As shown in FIG. 6, if the differential pressure set value ΔPLS is changed to a small value when the discharge pressure Pp of the hydraulic pump 8 takes a certain value Pp1 and the pump displacement q takes its maximum value qmax, this change of the differential pressure set value ΔPLS to that the right member of the equation above ($Q=c\cdot A\cdot\sqrt{(\Delta P)}$) becomes smaller. Accordingly, as indicated by the arrow E, the pump displacement q is changed from the maximum value qmax to a small value q1. The smaller pump displacement q makes the absorption torque, or the hydraulic load of the hydraulic pump 8 smaller.

According to the present embodiment, the control to prevent the engine stall is performed by utilizing the LS control and differential pressure set value changing functions and devices provided in the wheel loader 100.

Specifically, when the engine speed Nr detected by the engine speed detecting sensor 1*a* is higher than the threshold value Nc, the controller 18 outputs a control signal i2 to the LS valve 22 to set the differential pressure set value ΔPLS to a large value to increase the absorption torque by the hydraulic pump 8. When the engine speed Nr detected by the engine speed detecting sensor 1*a* then becomes equal to or lower than the threshold value Nc, the controller 18 outputs a control signal i2 to the LS valve 22 to set the differential pressure set value ΔPLS to a small value to reduce the absorption torque by the hydraulic pump 8. When the engine speed Nr detected by the engine speed detecting sensor 1*a* again becomes higher than the threshold value Nc, the controller 18 outputs a control signal i2 to the LS valve 22 to set the differential pressure set value ΔPLS to the large value to increase the absorption torque by the hydraulic pump 8. The engine stall prevention control as shown in FIGS. 4A, 4B, and 4C is realized by these procedures, and the torque of the engine 1 can be increased in accordance with the hydraulic load of the engine 1 to establish matching at the matching point V1 of the high hydraulic load Tp1 without stalling the engine 1.

Alternatively, the differential pressure set value ΔPLS may be set to the large value to return the absorption torque by the hydraulic pump 8 to the large value upon elapse of a predetermined period of time after the differential pressure set value ΔPLS is set to the small value to reduce the absorption torque by the hydraulic pump 8.

According to the present embodiment as described above, the engine stall due to rapid application of a high hydraulic load to the engine can be prevented by utilizing the LS control and differential pressure setting value changing control functions and devices provided in the wheel loader 100.

Further, the engine stall may be prevented by combination of the control to change the maximum absorption torque illustrated in FIG. 5 and the control to change the pump displacement illustrated in FIG. 6.

Further, when the engine speed Nr becomes the threshold value Nc or lower, the maximum absorption torque or displacement may be reduced for all the variable displacement hydraulic pumps 7, 8, and 9, or the maximum absorption torque or displacement may be reduced for one or two of the variable displacement hydraulic pumps 7, 8, and 9.

As shown in FIG. 1, the embodiment described above employs a hydraulic circuit in which pressure oil is supplied from each of the plurality of variable displacement hydraulic pumps 7, 8, and 9 to each of the plurality of hydraulic actuators 13, 14, and 15 via each independent oil passage.

When employing such a hydraulic circuit in which pressure oil is supplied from each of the plurality of variable displacement hydraulic pumps 7, 8, and 9 to each of the plurality of hydraulic actuators 13, 14, and 15 via each independent oil passage, the displacements of the hydraulic pumps 7, 8, and 9 must be determined respectively in accordance with the maximum loads of the corresponding hydraulic actuators 13, 14, and 15. As a result, the displacements of the variable displacement hydraulic pumps 7, 8, and 9 tend to become larger.

In contrast, when employing a hydraulic circuit in which flows of pressure oil discharged from the plurality of variable displacement hydraulic pumps are merged and differential pressures upstream and downstream of the control valves are adjusted by a pressure compensation valve before splitting and supplying the pressure oil to the plurality of hydraulic actuators, the amounts of flow can be allocated in accordance with the loads of the respective hydraulic actuators. Therefore, the displacements of the variable displacement hydraulic pumps can be made smaller.

For this reason, in the hydraulic circuit as shown in FIG. 1, the hydraulic load tends to become larger and thus the necessity of implementing the engine stall prevention control is higher in comparison with a hydraulic circuit employing a pressure compensation valve.

The description above has been made in terms of the case in which the engine stall prevention control illustrated in FIGS. 4A through 4C is implemented when the accelerator pedal 17 is not depressed and the engine speed is at the low idling speed NL. However, the present invention is not limited to this, and the engine stall prevention control illustrated in FIGS. 4A through 4C may be implemented similarly regardless of the engine speed of the engine 1. The threshold value Nc used for determining the possibility of stall of the engine 1 may be set to a different value according to the current engine speed Nr. For example, when the engine 1 is operating at an engine speed Nr that is higher than the low idling speed NL, the threshold value Nc for determining the possibility of engine stall may be set to an engine speed slightly higher than the low idling speed NL. Obviously, the threshold value Nc may be uniformly set to an engine speed equal to or lower than the low idling speed NL regardless of the engine speed Nr.

Further, the threshold value may be set according to the depressing amount (accelerator pedal opening) S of the accelerator pedal 17, so that the control is implemented similarly to reduce the pump absorption torque by using the threshold value Nc (S) that is defined by the variable of this accelerator pedal operating amount S.

More specifically, when the operator rapidly operates the loader operating lever to the raising direction while operating the steering handle with the accelerator pedal 17 being depressed, for example, the hydraulic loads in the steering hydraulic pump 7 and the loader hydraulic pump 8 are raised rapidly.

Figure 9A:
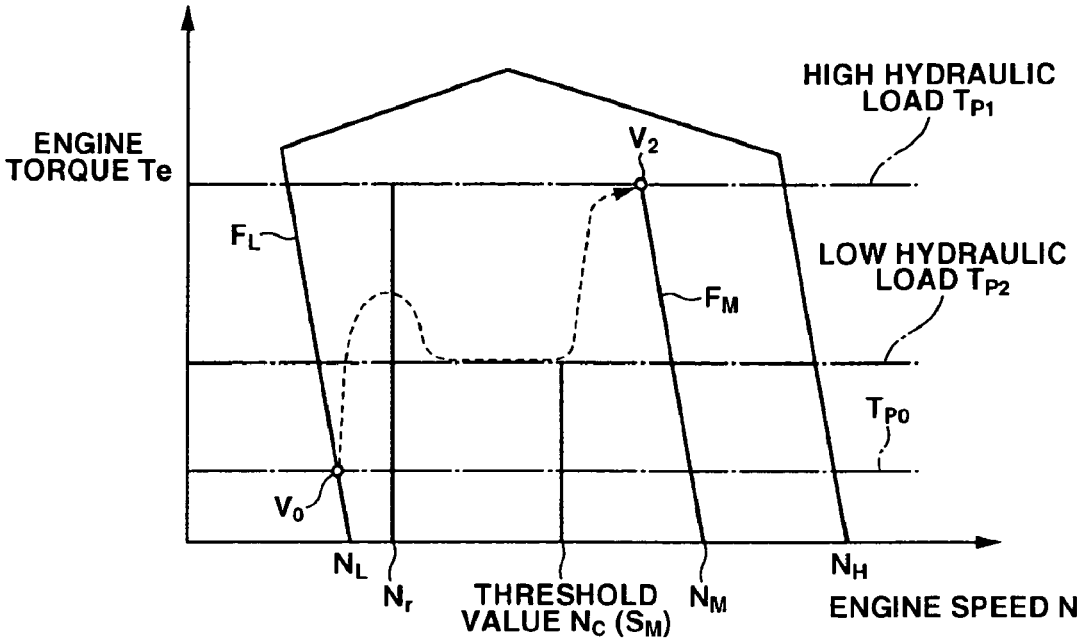
FIG. 9A is a diagram for explaining particulars of an engine stall prevention control according to the embodiment.
Figure 9B:
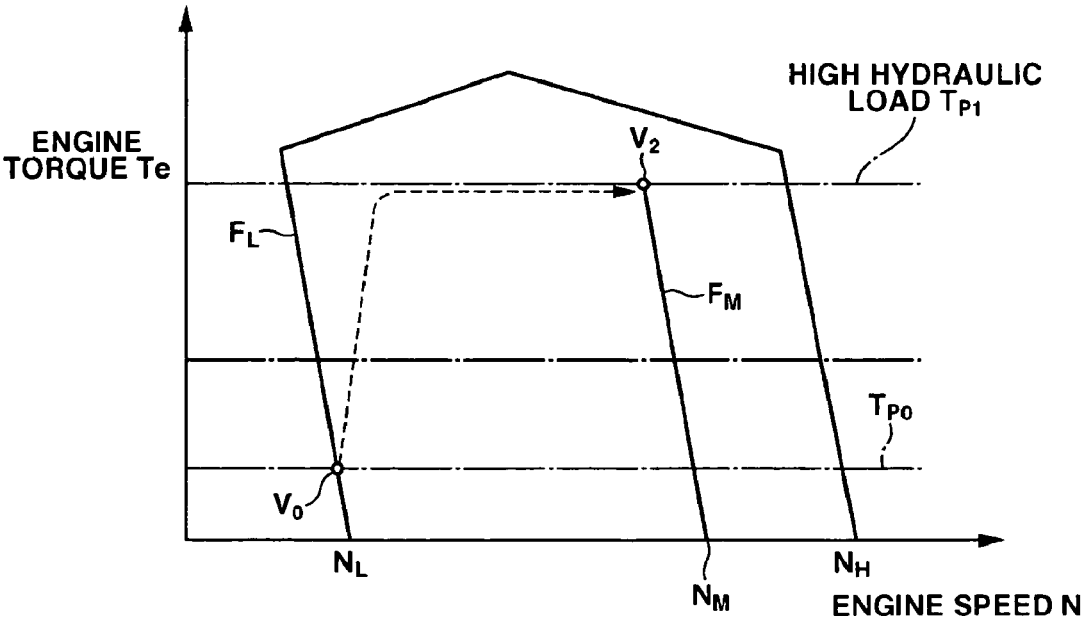
FIG. 9B illustrates a case as a comparative example in which the engine stall prevention control is not performed.

A description will now be made on the transient characteristic of the engine when the control of the present invention is implemented under such circumstances (FIG. 9A) in comparison with the transient characteristic of the engine when the control of the present invention is not implemented (FIG. 9B).

In FIG. 9B, the hydraulic load is moved from the low hydraulic load line indicated by Tp0 to the high hydraulic load line indicated by Tp1. Since the accelerator pedal 17 is depressed, the target speed of the engine 1 is changed from the low idling speed NL to the high target speed NM.

The regulation line of the engine 1 need to be altered from the low-speed regulation line FL to the high-speed regulation line FM. The engine torque needs to be altered from a low torque corresponding to the low hydraulic load Tp0 to a high torque corresponding to the high hydraulic load Tp1.

Therefore, the engine 1 tries to increase the engine speed, so that the matching point of the engine torque and the hydraulic load tries is shifted from the low speed and low hydraulic load point V0 (the point V0 on the regulation line FL) to the high speed and high hydraulic load point V2 (the point V2 on the regulation line FM). However, since the hydraulic load remains at the high value Tp1 and there is no sufficient margin for the engine torque, the increase in the engine speed Nr of the engine 1 is so slow that it takes a long period time to reach the matching point V2. Further, in some cases, the condition as shown in FIG. 4A may occur to cause the engine to stall.

Figure 10:
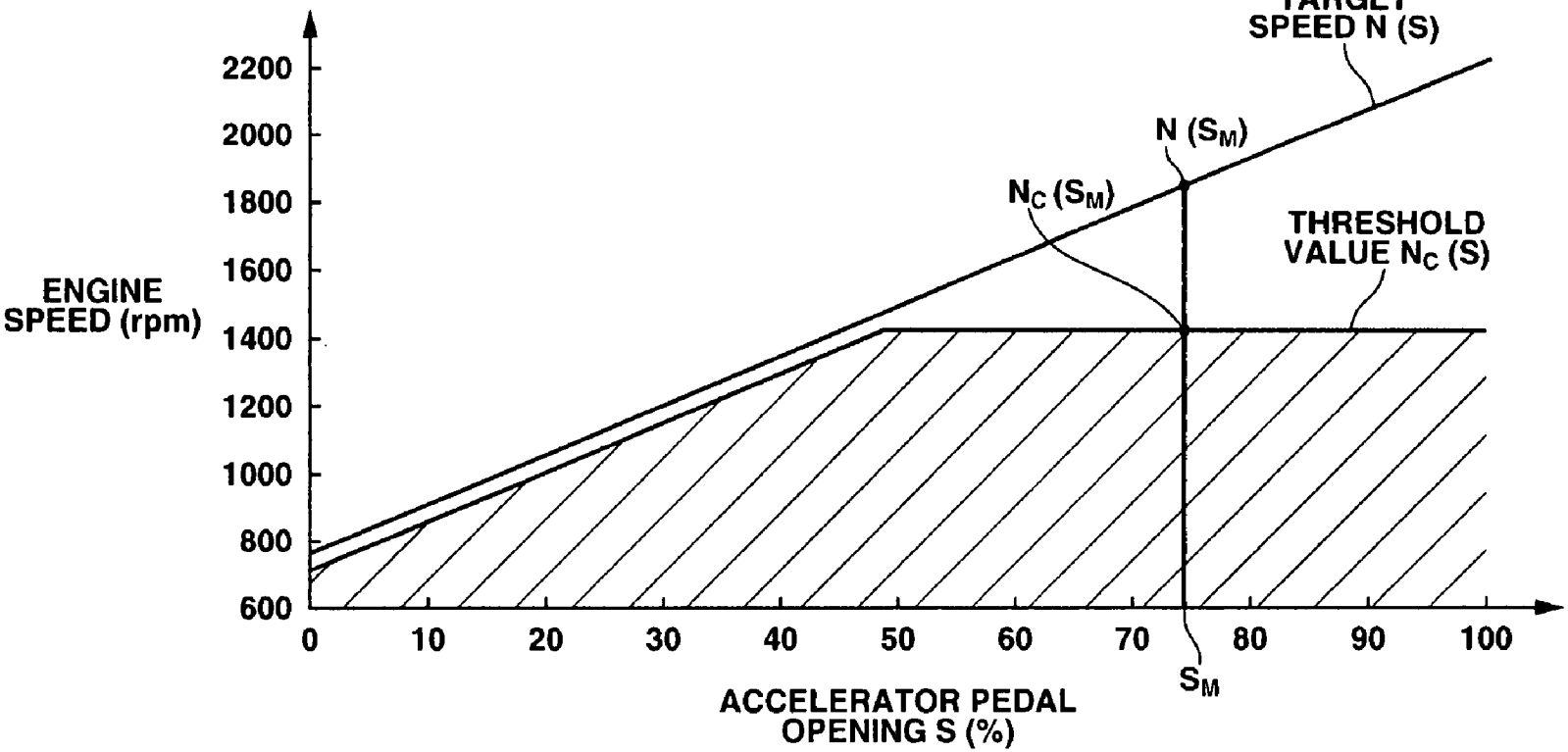
FIG. 10 is a diagram illustrating a relationship among an accelerator pedal opening, a target engine speed, and a threshold value.

In contrast, according to the present invention, as shown in FIG. 10, the threshold value Nc (S) is set according to the operating amount S (accelerator pedal opening) of the accelerator pedal 17. This threshold value Nc (S) is a threshold value for determining the possibility of engine stall or deterioration of accelerating ability. If the actual engine speed Nr is equal to or lower than the threshold value Nc (S) (in the shadowed region in FIG. 10), it is determined that there is a possibility of engine stall or deterioration of the accelerating ability, and the control is implemented to reduce the absorption torque of the variable displacement hydraulic pumps 7, 8, and 9.

In FIG. 10, the line indicated by N (S) represents the target engine speed (the engine speed under the non-load condition) that is set according to the operating amount S (accelerator pedal opening) of the accelerator pedal 17.

When the accelerator pedal 17 is depressed, the target engine speed NM is set according to the depressing amount SM (see FIG. 10 and FIG. 9A). Further, the threshold value Nc(SM) is determined according to the accelerator pedal depressing amount SM (see FIG. 10 and FIG. 9A).

As shown in FIG. 9A, the controller 18 determines whether or not the detected engine speed Nr has been decreased to the predetermined threshold value Nc(SM) or lower in the course when the accelerator pedal 17 is depressed to the operating amount SM and the matching point is shifted from the low speed and low hydraulic load matching point V0 (the point V0 on the regulation line FL) to the high speed and high hydraulic load matching point V2 (the point V2 on the regulation line FM). If the controller 18 determines that the detected engine speed Nr has been decreased to the predetermined threshold value Nc(SM) or lower, the controller 18 performs the control to reduce the absorption torque of the variable displacement hydraulic pumps 7, 8, and 9. The hydraulic load is thus shifted to the low hydraulic load line indicated by Tp2 as shown in FIG. 9A. As a result of the hydraulic load being changed from the high hydraulic load Tp1 to the low hydraulic load Tp2, the current torque of the engine 1 is allowed to have a margin with respect to the low hydraulic load Tp2, and the actual speed Nr of the engine 1 is increased rapidly.

If the controller 18 determines that the detected engine speed Nr is not equal to or lower than the predetermined threshold value Nc (S) in the course when the matching point is shifted from the low speed and low hydraulic load matching point V0 (the point V0 on the regulation line FL) to the high speed and high hydraulic load matching point V2 (the point V2 on the regulation line FM), the controller 18 terminates the control to reduce the absorption torque of the variable displacement hydraulic pumps 7, 8, and 9. Alternatively, the control may be terminated upon elapse of a predetermined period of time after starting the control to reduce the absorption torque of the variable displacement hydraulic pumps 7, 8, and 9.

As a result, the matching point is rapidly shifted to the matching point V2 on the regulation line FM.

As described above, the absorption torque of the variable displacement hydraulic pumps 7, 8, and 9 is reduced only for a minimum required period of time to prevent the engine stall or deterioration of the accelerating ability, whereas the absorption torque remains at a normal value when there is no risk of engine stall or deterioration of the accelerating ability. Further, the size of the engine need not be increased to give a margin to the engine torque.

Consequently, the engine stall, that tends to occur in a work vehicle such as a wheel loader due to rapid application of a high hydraulic load upon depressing of the accelerator pedal, can be prevented reliably, without inducing problems such as deterioration in fuel efficiency or vehicle performance, and waste of energy.

According to the present embodiment, the engine speed is rapidly increased to the target speed Nc (SM) when the accelerator pedal 17 is depressed, even under a high hydraulic load condition. Therefore, excellent accelerating ability can be obtained and the working efficiency can be improved remarkably.

The application of the present invention is not limited to a wheel loader, but similarly applicable to any type of work vehicles as long as the engine speed is changeable in a wide range (from a low idling speed to a high idling speed).

The invention claimed is:

1. A load control device for an engine of a work vehicle, comprising:

a driving wheel;

a plurality of variable displacement hydraulic pumps;

an engine in which a target speed is set to a value in a range from a low idling speed to a high idling speed, wherein the engine drives the driving wheel via a torque converter and drives the plurality of variable displacement hydraulic pumps;

a plurality of hydraulic actuators to which pressure oil discharged from the plurality of variable displacement hydraulic pumps is supplied, wherein the plurality of hydraulic actuators at least activate a work machine;

absorption torque changing means for changing absorption torque for one or more of the variable displacement hydraulic pumps;

engine speed detection means for detecting an engine speed; and control means for reducing the absorption torque of the variable displacement hydraulic pump when the detected engine speed is decreased to a predetermined threshold value or lower wherein the predetermined threshold value is set to an engine speed at which it is determined that there is a risk that the engine will stall.

2. The load control device according to claim 1, comprising:

a hydraulic actuator for activating a steering mechanism; and a hydraulic actuator for activating a work machine.

3. The load control device according to claim 1, wherein the absorption torque changing means is means for changing maximum absorption torque of the hydraulic pump.

4. The load control device according to claim 1, wherein the absorption torque changing means comprises:

displacement control means for controlling a displacement of the variable displacement hydraulic pump such that a differential pressure between a discharge pressure of the variable displacement hydraulic pump and a load pressure of the hydraulic actuator becomes a set differential pressure; and means for changing the set differential pressure.

5. The load control device according to claim 1, wherein the pressure oil is supplied from each of the plurality of variable displacement hydraulic pumps to each of the plurality of hydraulic actuators via each independent oil passage.

6. The load control device according to claim 1, wherein an operating element is provided for setting a target engine speed according to an operating amount thereof;

the predetermined threshold value is set according to the operating amount of the operating element; and the control means reduces the absorption torque of the variable displacement hydraulic pump when the detected engine speed decreases to the threshold value or lower.

7. A load control device for an engine of a work vehicle, comprising:

a driving wheel;

a plurality of variable displacement hydraulic pumps;

an engine in which a target speed is set to a value in a range from a low idling speed to a high idling speed, wherein the engine drives the driving wheel via a torque converter and drives the plurality of variable displacement hydraulic pumps;

a hydraulic actuator to which pressurized oil discharged from the variable displacement hydraulic pump is supplied, wherein the hydraulic actuator activates a work machine;

a valve apparatus for changing an absorption torque for the variable displacement hydraulic pump;

an engine speed sensor for detecting a speed of the engine; and a controller for reducing the absorption torque of the variable displacement hydraulic pump by controlling the valve when the detected engine speed is decreased to a predetermined threshold value or lower, wherein the predetermined threshold value is set to an engine speed at which it is determined that there is a risk that the engine will stall.

8. The load control device according to claim 7, comprising:

a hydraulic actuator for activating a steering mechanism; and a hydraulic actuator for activating a work machine.

9. The load control device according to claim 7, wherein the valve apparatus changes a maximum absorption torque of the hydraulic pump.

10. The load control device according to claim 7, wherein the valve apparatus comprises:

a valve for controlling a displacement of the variable displacement hydraulic pump such that a differential pressure between a discharge pressure of the variable displacement hydraulic pump and a load pressure of the hydraulic actuator becomes a set differential pressure; and a device for changing the set differential pressure.

11. The load control device according to claim 7, wherein the pressurized oil is supplied from the variable displacement hydraulic pump to the hydraulic actuator via an independent oil passage.

12. The load control device according to claim 7, wherein an operating element is provided for setting a target engine speed according to an operating amount thereof;

the predetermined threshold value is set according to the operating amount of the operating element; and the controller reduces the absorption torque of the variable displacement hydraulic pump when the detected engine speed decreases to the threshold value or lower.

* * * * *